US007377487B2

(12) United States Patent
Otten

(10) Patent No.: US 7,377,487 B2
(45) Date of Patent: May 27, 2008

(54) HOLDING DEVICE FOR HANDLING TOOLS

(75) Inventor: Juergen Otten, Tiste (DE)

(73) Assignee: Airbus Deutschland GmbH, Hamburg (DE)

( * ) Notice: Subject to any disclaimer, the term of this patent is extended or adjusted under 35 U.S.C. 154(b) by 202 days.

(21) Appl. No.: 11/270,722

(22) Filed: Nov. 8, 2005

(65) Prior Publication Data

US 2006/0118689 A1 Jun. 8, 2006

Related U.S. Application Data

(60) Provisional application No. 60/626,049, filed on Nov. 8, 2004.

(30) Foreign Application Priority Data

Nov. 8, 2004 (DE) ..... 10 2004 053 809

(51) Int. Cl.
*B66D 3/04* (2006.01)

(52) U.S. Cl. ..... 254/392; 254/397; 254/398; 248/322; 248/328; 248/332

(58) Field of Classification Search ..... 254/388, 254/392, 394, 396–398, 401; 248/317, 322, 248/328, 332

See application file for complete search history.

(56) References Cited

U.S. PATENT DOCUMENTS

| | | | | |
|---|---|---|---|---|
| 2,176,979 | A | 10/1939 | Platz | |
| 2,463,394 | A * | 3/1949 | King | 254/337 |
| 4,796,863 | A * | 1/1989 | Reed | 254/337 |
| 5,207,114 | A * | 5/1993 | Salisbury et al. | 74/479.01 |
| 5,762,279 | A * | 6/1998 | Horton, III | 254/285 |
| 6,631,885 | B2 * | 10/2003 | Halas | 254/225 |
| 6,820,853 | B1 * | 11/2004 | DuBarry | 248/489 |
| 7,007,927 | B2 * | 3/2006 | Halas | 254/225 |
| 7,093,823 | B2 * | 8/2006 | Sevalie' | 254/337 |

FOREIGN PATENT DOCUMENTS

DE 199 27 645 A1 12/2000

* cited by examiner

*Primary Examiner*—Emmanuel M Marcelo
(74) *Attorney, Agent, or Firm*—Christopher Paradies; Fowler White Boggs Banker P.A.

(57) ABSTRACT

A holding device is designed to compensate for the weight of a tool using a non-vertical length of an elastic rope. The elastic rope may be redirected using a pulley mounted to a carrier that is mounted to a support structure. The user is able to use the tool without supporting the entire weight of the tool during use.

12 Claims, 2 Drawing Sheets

HOLDING DEVICE FOR HANDLING TOOLS

RELATED APPLICATIONS

This application claims the benefit of the filing date of U.S. Provisional Patent Application No. 60/626,049 filed Nov. 8, 2004, and of German Patent Application No. 10 2004 053 809.3 filed Nov. 8, 2004, the disclosures of which are hereby incorporated herein by reference.

FIELD OF THE INVENTION

The field relates to a holding device. The field specifically relates to a holding device for holding a load, the use of such a holding device as an aid in the assembly of an aircraft and the use of a holding device for holding a tool.

TECHNOLOGICAL BACKGROUND

In assembly tasks, particularly tasks associated with the manufacture of an aircraft, a heavy tool (e.g., a drill) frequently needs to be operated in an ergonomically unfavorable posture. The weight of such a tool may exceed 3 kg. However, a tool of this type needs to be positioned properly during the assembly, for example, overhead, in order to carry out the required tasks. Drill holes also need be arranged in a highly precise fashion so as to prevent tensions from occurring in a fairing section mounted thereon.

The tasks to be carried out with this tool may go on for an extended period of time such that the operator suffers significant strain on the body. The ergonomically unfavorable posture may also lead to health problems. Rapid fatigue of the operator may also be caused by an unfavorable posture. As a consequence, suspended balancer systems are nowadays used for assembly tasks in sufficiently large workshops. These balancer systems may reduce the apparent weight of a tool. However, these suspended balancer systems require sufficient space that is frequently not available, for example, in aircraft manufacturing processes. Additionally, conventional balancer systems currently used are quite heavy.

SUMMARY OF THE INVENTION

A holding device comprises a portion of elastic rope. Elastic rope may be made of any material having elasticity. The elastic rope may be selected such that a weight of a tool or other device that is acting upon the rope is supported, at least partially, by the rope within a dynamic range needed for use of the tool. The holding device has a portion of the elastic rope that extends non-vertically, such as in a casing having a pulley that feeds the rope from a non-vertical to a vertical direction. Thus, the length of the elastic rope may be increased to increase the dynamic range without requiring a long vertical length from the mounting point of the holding device to the position of the tool. In this way, a holding device and tool may be used in situations that require a low vertical profile.

The elastic rope may be advantageously able to accommodate a weight acting upon it such that a state of equilibrium may be adjusted. In other words, a load such as a tool acting upon the elastic rope in the form of a weight essentially appears weightless or levitated. Consequently, a force that corresponds to the weight of the load in order to lift the load, for example, in order to change the height of a load, need not be exerted. Instead the elastic rope may carry part of the load.

During the operation of a tool, for example, a power screwdriver or a drill, the operator of the tool may have to exert two types of forces in peculiar installation positions, for example, the first type, a force that corresponds to the weight of the tool as well as a second type, a pressing force in order to carry out the task at hand. In drilling processes, the pressing force may serve to penetrate an obstacle, for example, a wall or a metal plate. With respect to the safe handling of the tool and improved fine motor skills, the operator of the tool may utilize a holding device in order to exert the holding force that corresponds to the weight of the tool. A tool that is arranged on an elastic rope may thus be brought into a state in which the operator perceives it to have little or no weight. Thus, the force to be exerted by the operator with the use of a holding device may be reduced as compared to situations in which the operator holds the tool alone without a holding device.

A section of the elastic rope extends non-vertically, allowing the holding device to be used in confined spaces, such as arise locations with limited available vertical height, when sufficient space is available in a non-vertical direction.

The installation position of a tool on the elastic rope may lie very close to the area to be processed, for example, when assembly tasks underneath false floors in aircraft are carried. Due to its low weight, the holding device may be clamped between the carriers of the false floor, e.g., the floor beams, in a self-supporting fashion in such instances. Thus, mounting means such as belts for mounting the holding device may be eliminated. Consequently, only a low amount of force may need to be exerted in order to hold the tool even at short distances from the area to be processed. In addition to the assembly of aircraft, the holding device may also be utilized in numerous other applications, for example, by hobbyists, in shipyards and in car and railway construction. In all these applications, the holding device may allow for an ergonomic working posture, and its simple mounting may not require auxiliary devices such as belts. The setup time may be reduced in this fashion.

When using an elastic rope, a certain length may be required in order to reach the required dynamics. This certain length of the elastic rope may be required for bringing the elastic rope into a dynamic range or working range. In this working range, the elastic rope generates a counterforce against the weight of the tool or other device being supported by the rope. In a position in which the elastic rope extends non-vertically, a sufficient length may be used for adjusting the elastic rope to the required dynamic range. If required, the length may be altered by winding of the rope around pulleys, on a spool or in any other manner that provides for a length of rope needed for a particular dynamic range.

The elastic property of the elastic rope may be adjusted by varying a pre-stress and/or length or varying a length from the relaxed state of the rope. For example, the utilization of auxiliary weights may adjust an elastic rope to a working range or dynamic range, in which it may have sufficient dynamics. For example, the weight of a tool attached to the elastic rope may not suffice for extending the elastic rope. However, the elastic rope may require a certain pre-stress in order to achieve a weightless movement of the tool over a certain length range. In one example, the required pre-stress of the elastic rope may be accomplished with an auxiliary weight.

The elastic rope of the holding device may include a fastening device. Examples of such fastening devices include a hook, a spring hook and/or a clip. A load such as a tool may thus quickly and easily attached to the fastening device.

In another example, the holding device may include a safety mechanism. This safety mechanism may prevent a load such as a tool from uncontrollably slipping or falling in case, the elastic rope tears. In one example, the safety mechanism includes a brake, A brake, through which the elastic rope runs, may prevent the load from falling on the ground if the elastic rope tears. The brake may be triggered, for example, during a fast acceleration and may remain inoperative during slow accelerations.

In another example of a safety mechanism, a rigid safety cord may be used. For example, a cord including a wire braiding which has a greater length than the elastic rope in a working range may prevent, a tool from falling onto the ground if the elastic rope tears. In other words, a load may be attached to the wire rope as well as the elastic rope. In one example, the elastic rope may be under tension in a working point while the wire rope may not be subjected to any tension. In another example, the wire rope may be tensioned by the load if the elastic rope is overextended or tears. The wire rope may have such dimensions of length that the tool may be prevented from falling on the ground. In another example, recoiling of the elastic rope may also be prevented with a corresponding safety mechanism. For example, the elastic rope may have an extension such that the counter-force attempts to relax the rope and the relaxation of the rope may thus be prevented with a safety mechanism.

In another example of the invention, the holding device includes a carrier and a deflection device. The deflection device is arranged on the carrier and deflects the elastic rope in such a way that the force of a weight attached to the elastic rope is deflected.

The weight of a tool is a vector having a magnitude and a direction. The direction is the direction of gravity (i.e. the vertical direction). The deflection device, when mounted on a supported structure resolves the weight in the vertical direction into a vertical and a non-vertical component, the non-vertical component being taken up by the elasticity of the rope. The vertical and non-vertical forces may be influenced by altering the angle of installation of the carrier, to which the rope is attached.

One advantage of the holding device is that it is capable of installation in a location having a confined vertical height. The deflection device allows for extension of the elastic rope in a non-vertical direction such that a large dynamic range is provided without the need for a large vertical distance between the mounting point and the tool or other device. A broad dynamic range, may be achieved even if the vertical installation space is confined. This may be particularly advantageous in the assembly or manufacturing of an aircraft. For example, a carrier may be mounted on frame components of an aircraft by mounting elements such as belts. In cases of confined space, an aircraft fuselage may provide sufficient space in non-vertical directions, such as in the longitudinal direction of the aircraft fuselage, while vertical space is severely limited.

In another example, the carrier of the holding device includes a first length adjusting device. The elastic rope has a first end, which may be fixed on the first length adjusting device. In this case, the first end of the elastic rope is spaced apart from the deflection device by a first distance, and the length adjusting device may be designed in such a way to adjust this first distance.

A distance to the deflection device may be adjusted by the length adjusting device. A working height may thus be adjusted. For example, a significant extension of the elastic rope may occur if a heavy load or a heavy tool is suspended thereon. The length adjusting device may adjust the required working height of the tool.

In another example, the carrier may include a second length adjusting device. The second length adjusting device may be designed in such a way that it is able to vary a first length of the carrier. The working height of a tool attached to the elastic rope may be advantageously adjusted by varying the length of the carrier. Thus, a dynamic range of the elastic rope may be advantageously adjusted.

In another example, the carrier of the holding device may include a mounting device. The mounting device may be designed for mounting of the carrier on a support. The carrier may be mounted on a support by this mounting device, for example, a hook, a spring hook or a cable. The mounting device may simplify the process of fixing the holding device in a non-vertical working position and may also be used for adjusting the height of the holding device.

In one example, the deflection device of the holding device may be in the form of a roll or pulley. A loss of the dynamics of the elastic rope due to frictional loss may thus be prevented. For example, rolls may be supported by sliding bearings or ball bearings in order to prevent frictional losses. The elastic rope is also prevented from sliding over any sharp edges when a roll is utilized.

In still another example, the carrier of the holding device may include a damping device. The damping device may assist the elastic rope in carrying the load and in reaching a dynamic range. An adjustable damping element may thus fine-tune the dynamic range of the elastic band.

One advantage is that the holding device may aid in the assembly of an aircraft and may significantly simplify the work to be performed by the respective assembly personnel when utilized as a tool holder. Another advantage of the holding device is to help allow for an ergonomic working posture and to help assist in preventing health problems. The reduced strain may mean that workers are able to work for extended periods of time without becoming fatigued.

DESCRIPTION OF THE DRAWINGS

Examples of the present invention are described below with reference to the figures.

DETAILED DESCRIPTION OF THE PREFERRED EMBODIMENTS

The following examples describe some aspects of the present invention for purposes of providing a person of ordinary skill in the art to understand the embodiments of the invention, but the claims are not to be limited merely to these examples.

Figure 1:
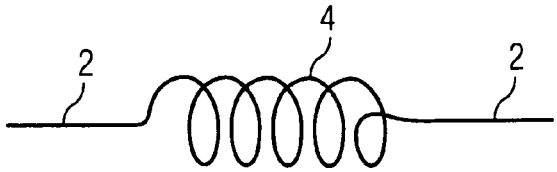
FIG. 1 shows a schematic representation of an elastic rope.

In FIG. 1, the schematic illustration of an elastic rope includes oblong sections 2 with a spring element 4. Oblong sections are depicted but any geometric shape is allowed. Depending on the choice of components 2, 4, the elastic rope may be in the form of a partially or fully elastic rope. Elastic materials such as rubber or nylon may be used for the oblong components 2.

Elastic and at least partially elastic ropes may be formed in many different ways. For example, elastic ropes may be in the form of elastic bands, elastic fabrics and single elastic strands that are assembled into a rope, as well as in the form of ropes that are assembled from mixed materials or inelastic cords that have a covering of elastic material. Elastic or partially elastic ropes may also include an inelastic rope and a damping element.

The oblong components 2 may be made of an inelastic material, a partially elastic material or a fully elastic material. If elastic materials are used for the oblong components 2, a spring component 4 may not be needed to achieve the elastic properties of the rope sufficient to operate within a designed dynamic range. An elastic rope may include a length of inelastic material by utilizing an elastic section 4, e.g., a spring element or rubber element that provides an adequate dynamic range. In one example, the end of the rope 14 that is capable of being attached to the tool is made of an inelastic material or a material having an elasticity much less than the elasticity of the elastic portion 4 of the rope 14. The required elasticity of the elastic rope may also be achieved by arranging the elastic element 4 at the beginning or the end of only one inelastic section 2.

In a fully elastic rope, all sections and components are made of materials exhibiting elastic properties. However, the term "elastic rope" includes both fully and partially elastic rope. It may also include connectors between portions of the rope and the rope and the holding device.

The elasticity of the elastic rope may be adjusted and readjusted by selecting the materials and elasticities of the respective sections 2 and 4 forming the elastic rope accordingly. One example of an elastic property would be "hard elasticity" or "hard elastic." In this context, a hard elasticity means that the elastic rope may only be extended by exerting a high amount of force while a "soft elastic rope" is already extended when low amount of forces act thereupon. Consequently, a hard elastic rope may be used, for example, for a heavy tool and a soft elastic rope may be used for a light tool. A rope 14 may be comprised of both hard and soft elastic portions, but the portion of the rope carrying the weight of the tool should be capable of safely carrying the weight of the tool without failing.

The length or distance of the extension of the elastic rope for reaching a working range may be adjusted by realizing the sections 2 and 4 of the elastic rope accordingly. The terms "working range" or "dynamic range" refers to the range in which the elastic rope elastically compensates for at least a portion of the normal weight of the tool during normal use of the tool or any other device. The elastic rope has the capability of supporting the entire weight of the tool at an equilibrium point within the dynamic range. The dynamic range is broad enough to provide the user with a significant mechanical advantage throughout the dynamic range, such that the tool may be used without fatiguing the user, for example. In other words, a force acting upon the elastic rope causes the elastic rope to extend until the counterforce generated due to its elasticity compensates for this force. For example, if a tool is suspended on an elastic rope and the tool is in a working range of the elastic rope, the operator may be able to lift the tool by exerting a comparatively low amount of force. The force to be exerted by the operator corresponds only to the difference between the weight of the tool and the force generated by the elastic rope at the respective length thereof.

Any type of elastic bands, fabrics and mixed materials of elastic components and inelastic components may be used for the elastic rope. Wire ropes provided with a covering of an elastic material may also be used. In one example, however, the length of the elastic component in the relaxed state is shorter than the length of the inelastic component in the relaxed state. Thus, the extension of the elastic component to a certain length is enabled. This certain length corresponds to the length of the inelastic component. In case the elastic component tears or breaks apart, a safety mechanism may be utilized or a stop, which defines the maximum extension of the rope, is achieved.

Figure 2:
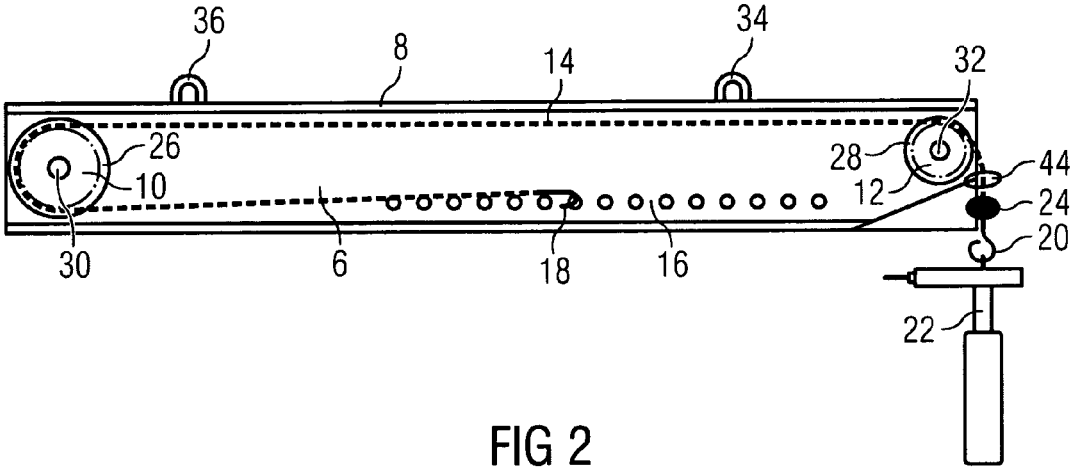
FIG. 2 shows a schematic representation of one embodiment of the present invention.

In FIG. 2, the holding device includes a carrier 6. The carrier 6 is shown in a non-vertical working position in FIG. 2. In one example, the carrier 6 may be in the form of a rectangular carrier, with a greater length than its height. The carrier may be stabilized and secured against movement into and out of the plane of projection by a reinforcement 8. A housing for protecting the holding device from external influences, such as the environment, may be mounted on the reinforcement 8.

The carrier 8 has a front end and a rear end. The front rope guide roll 12 is arranged on the front end. The rear rope guide roll 10 is arranged on the rear end. The diameter of the front rope guide roll 12 is smaller than the diameter of the rear rope guide roll 10. The front rope guide roll 12 and the rear rope guide roll 10 respectively have an axis 32, 30. The axes 32 and 30 may be in the form of sliding bearings.

The mounting devices 34 and 36 are arranged on the upper side of the carrier 6. The carrier may be mounted on a support by these mounting devices. The mounting devices allow for the carrier to be mounted and held in a non-vertical position during use. The axis 32 of the front rope guide roll 12 is spaced a shorter distance apart from the upper side of the carrier 6 than the axis 30 of the rear rope guide roll is to the carrier 6's upper side. The front rope guide roll 12 and the rear rope guide roll 10 may respectively have a rope guide 28 and 26. The elastic rope 14 is guided over the front rope guide roll 12 and the rear rope guide roll 10. The rope guides 28 and 26 prevent the elastic rope 14 from slipping off the front and rear rope guide rolls 10 and 12.

Due to the shorter distance of the axis 32 from the upper side of the carrier and the utilization of a front rope guide roll 12 with a smaller diameter than the rear rope guide roll 10, the elastic rope 14 extends non-vertically, such as in a direction that accommodates the rope 14 within the carrier. In one example, a portion of the rope is located parallel to the upper side of the carrier 6, in the region between the front rope guide roll 12 and the rear rope guide roll 10. The elastic rope 14 is looped around the rear rope guide roll by approximately 180 degrees such that the direction of the rope is reversed. This causes the rope to be deflected closer to the underside of the carrier, wherein the rope also extends essentially parallel to the upper side of the carrier on the underside thereof. The underside of the carrier may lie opposite of and also extends parallel to the upper side of the carrier. Consequently, a lower section of the elastic rope may also extend in a direction parallel to the underside of the carrier.

A row of apertures 16 is arranged in the lower region of the carrier 6 in the example illustrated. The row of apertures 16 includes 15 apertures that are arranged on the underside of the carrier 6 and equidistantly spaced apart from one another. The apertures forming the row of apertures 16 also have the same diameter. The elastic rope 14 may include a hook 18 on one end of the elastic rope 14. The row of apertures 16 may be partially covered by the elastic rope 14. The alignment of the row of apertures 16 corresponds to that of the lower section of the elastic rope 14 and also extends parallel to the underside of the carrier 6. The hook 18 engages into one of the apertures forming the row of apertures 16.

The apertures of the row of apertures 16 are spaced apart from the axis 30 of the rear roll by different distances. The distance between the apertures of the row of apertures 16 and the axis 30 increases in the direction toward the front side of the carrier 6. Thus, the section of the elastic rope 14 that extends non-vertically may lengthen or shorten. In other words, the upper side as well as the underside of the carrier 6 extends non-vertically if the carrier 6 is mounted on a support by the mounting devices 36 and 34, for example. Therefore, a significant section of the elastic rope 14 also extends non-vertically.

The elastic rope 14 extends in the front region of the carrier, i.e., around the region of the front rope guide roll 12. A load 22, for example, a tool is attached to a hook 20. This tool 22 has a certain weight. If the carrier 6 is mounted non-vertically, the weight of the tool 22 still acts in the vertical direction (i.e. the direction of gravity). The hook 20 may be fixed on the front end of the elastic rope 14. Thus, an application of the weight of the tool 22 into the elastic rope 14 takes place.

Consequently, a vertical force also acts upon the section of the elastic rope 14 that extends between the hook 20 and the contact point between the elastic rope 14 and the front rope guide roll 12. The vertical section of the rope 14 is shorter than the section of the rope 14 that extends non-vertically, for example. The vertically acting weight is converted into a non-vertical force on the rope 14 by the front rope guide roll 12, wherein the now ensuing force now acts along the non-vertically extending section of the elastic rope 14. This results in the elastic rope 14 being extended. An additional auxiliary weight 24 may ensure that a sufficient vertical force for reliably guiding the elastic rope 14 over the rope guide roll 12 acts upon the elastic rope 14 when-the tool 22 is not suspended thereon.

The weight of the tool 22 causes the length of the elastic rope 14 to increase from its relaxed state. Since the longer section of the elastic rope 14 extends in the non-vertical direction, much of the change in length of the elastic rope 14 caused by the weight of the tool 22 takes place in the non-vertical direction. This allows the rope 14 to generate a force that acts opposite to the weight of the tool 22, namely without a significant change in length occurring in the vertical direction. The carrier 6 and the entire holding device consequently may be suitable for use under confined space conditions, for example, in aircraft fuselages.

The height of the tool 22 may be adjusted and the dynamic directional range of the elastic rope 14 may be adapted by adjusting the hook 18. In this context, a change in height refers to the underside of the hook 18 being spaced apart from the underside of the carrier 6 by a greater distance due to the weight 22 and the extension of the elastic rope 14 than in the relaxed state of the elastic rope. This distance between the underside of the hook 20 and the underside of the carrier 6 may be adjusted and adapted to a working range and/or dynamic range for a tool 22 by inserting the hook 18 into a different hole of the row of apertures 16. The hook 18 and the row of apertures 16 therefore form a length adjusting device.

The rolls 10 and 12 are able to turn about their axes during a length change of the elastic rope 14. An additional damping of the movement of the elastic rope and therefore the weight of the load 22 may be achieved by "cushioning" the axes 32, 30. The axes 32, 30 of the front rope guide roll 12 and the rear rope guide roll 10 may be decelerated by brakes, for example. This may provide an additional safety measure. The movement of the weight 22 may be compensated for by this cushioning of rolls 12, 10 using a braking mechanism.

Another safety measure may be provided by a safety mechanism 44. The vertical section of the elastic rope 14 extends through the safety mechanism 44. The safety mechanism 44 detects an excessively fast movement and/or extension of the elastic rope 14 as an uncontrolled or dangerous circumstance; therefore, the mechanism blocks the movement of the elastic rope under such circumstances. In one example, the load 22 is prevented from falling to the ground if the elastic rope 14 fails, such as by tearing or snapping loose from its mounting point.

The safety mechanism 44 may also be used for clamping the elastic rope in order to define a certain height for the tool 22 and to adjust the dynamic range of the elastic rope. Thus, the elastic rope may be fixed at a location and the movements are largely restricted. For example, the safety mechanism 44 may be comprised of a circular opening and hook. The diameter of the opening is smaller than the width of the hook 20. If the hook 20 is pulled excessively close to the axis 32 of the front rope guide roll due to the contraction of the elastic rope 14, the safety mechanism 44 prevents the hook 20 from being spaced apart from the axis 32 by less than a certain distance.

Figure 3:
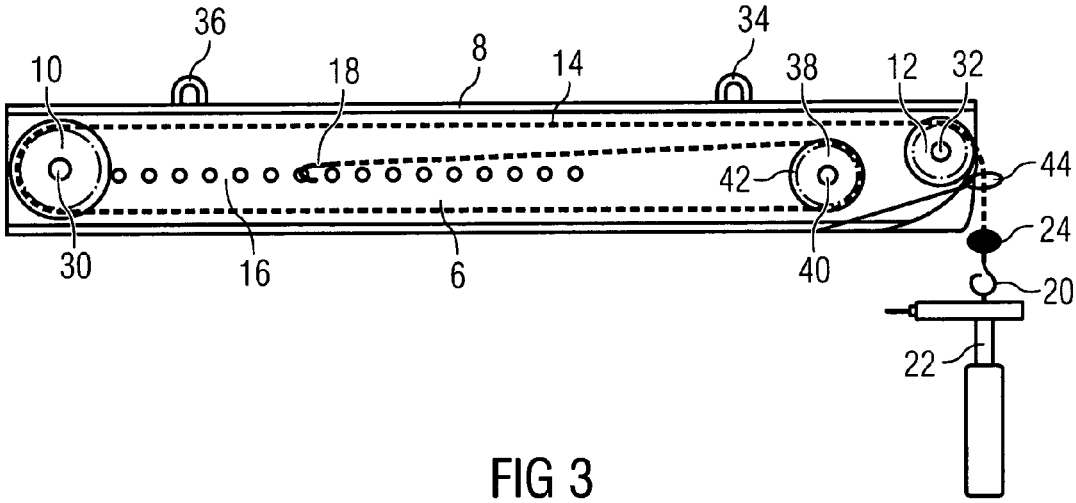
FIG. 3 shows another schematic representation of an embodiment of the present invention.

In FIG. 3, an additional second front rope guide roll 38 is arranged on the carrier 6. The second front rope guide roll has an axis 40 and a rope guide 42. The distance between the axis 40 and the rear axis 30 is smaller than the distance between the front axis 32 and the rear axis 30. The distance between the axis 40 and the underside of the carrier 6 is smaller than the distance between the rear axis 30 and the underside of the carrier 6. The diameter of the rope guide roll 38 is also smaller than that of the rear rope guide roll 10. Thus, the elastic rope 14 may be placed all around the rope guide roll 38, non-vertically and in the same direction as the underside. The rope guide roll 38 deflects the elastic rope 14 by approximately 180 degrees, so that the hook 18 of the elastic rope 14 may be inserted into the row of apertures 16. The elastic rope 14 is wound up in the holding device in this fashion.

The row of apertures 16 may be arranged in a rear position in the center between the upper side and the underside of the carrier 6. The section of the elastic rope that extends non-vertically may be extended by deflecting the elastic rope 14 with the aid of the rope guide roll 38. Any arbitrary length may be realized by providing additional rolls and length adjusting devices.

The utilization of additional rolls and therefore the extension of the rope 14 that extends non-vertically may be used for adapting the dynamic behavior of the entire arrangement. The extension of the elastic rope 14 and/or the section of the elastic rope 14 that extends non-vertically, may be realized without changing the height and/or the length of the carrier 6. That is, the installation height of the carrier 6 is not increased in this case. This means that very flat holding arrangements may be realized for use in areas having low height. The holding device may be adapted to different scenarios involving the weight of the tool and/or the working height or working position.

Figure 4:
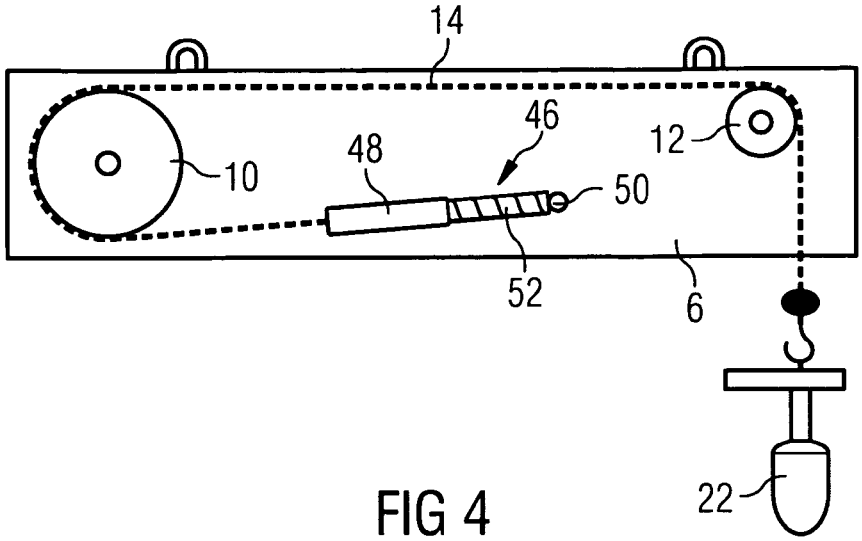
FIG. 4 shows a schematic representation of a first length adjusting device of one embodiment of the present invention.

In FIG. 4, the carrier 6 is shown with the front and rear rope guide rolls 12, 10, over which the elastic rope 14 is guided. A section of the elastic rope 14 extends vertically, nearly parallel to the upper side and the underside of the casing. The length of the section of the elastic rope 14 that extends non-vertically may be adjusted with the length adjusting device 46. The length adjusting device comprises a threaded housing 48 and a threaded rod 52. The threaded rod 52 is connected to the carrier 6 at the mounting point 50.

The elastic rope 14 may be connected to the threaded housing 48. The threaded housing 48 may be screwed on the threaded rod 52. Other attachment means are contemplated. This causes the distance between the end of the elastic rope 14 that is connected to the threaded housing 48 and the mounting point 50 to change. The length adjusting device 46 therefore serves to adjust the dynamic directional range of the elastic rope 14 and the working height of the tool 22, for example, a drill or power screwdriver. Instead of using the length adjusting device 46 with a threaded housing 48 and a threaded rod 52, other attachment means such as a Velcro fastener, a belt clip or a clamp instead may be used. The length of the section of the elastic rope 14 that extends non-vertically may be adapted by the length adjusting device 46, namely without having to change the length of the carrier 6.

Figure 5:
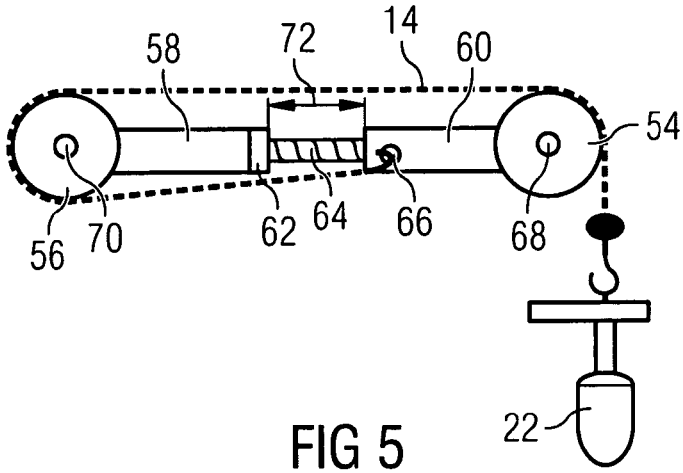
FIG. 5 shows a schematic representation of a second length adjusting device of one embodiment of the present invention.

In FIG. 5, two carrier elements 58 and 60 that are spaced apart by an adjustable distance 72 are depicted. The distance 72 is adjusted with a threaded rod 64 that is arranged on one end of the carrier element 60 and engaged with a thread 62 on one end of the carrier element 58. The carrier element 58 is hollow such that the threaded rod 64 may be engaged into the carrier element 58. The thread 62 may allow the threaded rod 64 to be screwed into the carrier element 58 whereby the distance 72 may be adjusted. A change in the distance 72 also causes the distance between the two rolling bearings 68 and 70 to change. The two axes 68 and 70 support the two rope guide rolls 54 and 56.

The elastic rope 14 is guided over the rope guide rolls 54 and 56. The length of the section of the elastic rope 14 that extends non-vertically may be changed by varying the distance between the rope guide rolls 56 and 54 together with the distance between the rolling bearings 68 and 70. The elastic rope 14 is rigidly connected to the housing part 60 at the mounting point 66. The length of the rope may thus be adapted to a dynamic directional range by adjusting the distance 72 with the aid of the second length adjusting device that includes the threaded rod 64 and the thread 62.

Figure 6:
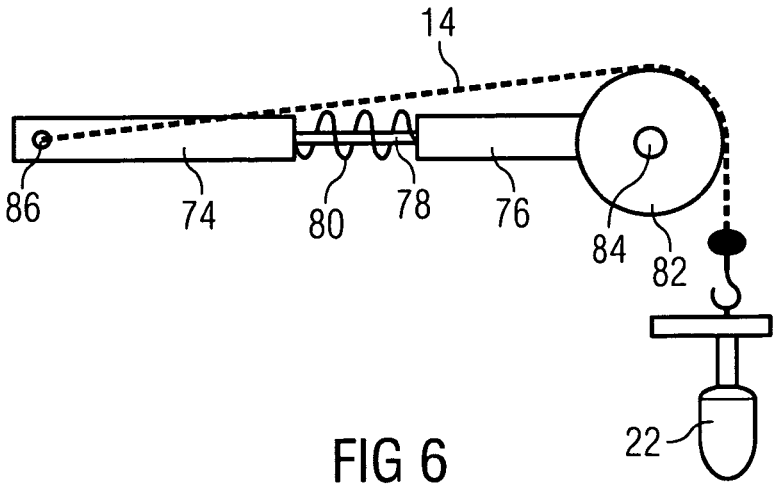
FIG. 6 shows a schematic representation of a damping device of one embodiment of the present invention.

In FIG. 6, two carrier elements 74 and 76 are connected by a damping element that includes the damping components, an immersion rod 78 and a spring 80. The damping components 80, 78 varies the distance between the carrier elements 74 and 76 in accordance with a force exerted on the carrier element 74 in the direction of the carrier element 76. In this arrangement, at least partially elastic rope includes the rope 14 and the damping components 80, 78. Thus, the rope 14 may be partially elastic as well as fully elastic. The rope 14 and the damping components 80, 78 together form an at least partially elastic rope which generates a counter-force for accommodating a force acting upon the rope. Consequently, a tool 22 may be brought into a state of equilibrium and its weight is accommodated.

The rope 14 is connected to the carrier element 74 at the mounting point 86. The rope guide roll 82 is connected to the carrier element 76 by the bearing 78. The rope 14 is deflected by the rope guide roll 82.

The weight of a load 22 that acts upon the rope 14 vertically is converted into a force that acts upon the rope 14 non-vertically by the rope guide roll 82. A significant section of the rope 14 extends non-vertically between the axis 84 and the mounting point 86. Thus, a force acting upon the carrier element 74 in the direction of the carrier element 76 also acts upon the damping components 80, 78. The spacing between the carrier elements 74 and 76 is dependent on the weight of the load 22. Therefore, the damping components 80, 78 may be used for adjusting a dynamic directional range of the at least partially elastic rope which includes the damping components 78, 80 and the rope 14. During a movement of the carrier element 74 in the direction of the carrier element 76 and a compression of the spring 80, the immersion rod 78 penetrates into a hollow area of the carrier element 74. The maximum extension caused by the load 22 may be adjusted by means of the maximum penetration depth of the immersion rod 78 into the carrier element 74.

When using an inelastic rope, the overall directional dynamics are defined by the damping components 80, 78 only.

In addition, it should be understood that the term "comprising" does not preclude any other elements or steps, and that the terms. "one" or "a" do not preclude a plurality. It should also be understood that characteristics or steps that were disclosed in connection with one of the above-described embodiments could also be utilized in combination with other characteristics or steps disclosed in connection with other above-described embodiments. The reference signs used in the claims should not be understood in a restrictive sense.

Implementation of the invention is not limited to the preferred embodiments shown in the drawings. Instead a multitude of variants are possible and will be readily apparent based on the examples described herein.

What is claimed is:

1. A holding device for a tool, comprising a rope having at least a portion that exhibits an elastic property, wherein the elastic property is selected such that the weight of the tool is supported by the rope, and the rope is mounted in the holding device such that at least a portion of the portion that exhibits the elastic property extends non-vertically while supporting the weight of the tool.

2. The holding device of claim 1, wherein the elastic property of the at least partially elastic rope is adjustable by varying a pre-stress or length of the rope.

3. The holding device of claim 1, wherein the rope includes a fastening device and the fastening device includes a weight.

4. The holding device of claim 1, further comprising:

a safety mechanism, wherein the safety mechanism prevents the tool from falling to the ground if the rope tears.

5. The holding device of claim 1, further comprising:

a carrier; and a deflection device, wherein the deflection device is mounted to the carrier and is designed for directing the rope such that the at least a portion of the portion of the rope that exhibits the elastic property is directed non-vertically within the carrier.

6. The holding device of claim 5, wherein the carrier includes a first length adjusting device and a first end of the rope is coupled to the first length adjusting device such that the first end of the rope is spaced apart from the deflection device by a first distance and the first distance is adjustable.

7. The holding device of claim 5, wherein the carrier has a first length, and the carrier includes a second length adjusting device, wherein the second length adjusting device is capable of varying the first length of the carrier.

8. The holding device of claim 5, further comprising:

a mounting device, wherein the mounting device is capable of mounting the carrier to a supporting structure.

9. The holding device of claim 5, wherein the deflection device is a roll.

10. The holding device of claim 5, wherein the carrier includes a damping device, the damping device applying a counterforce in order to damp forces applied to the rope.

11. An aircraft manufacturing process comprising a step of using the holding device of claim 1 to support the tool.

12. The holding device of claim 1, wherein the elastic property, including both a length and an elastic modulus of the rope, is selected to accommodate the weight of the tool.

* * * * *